United States Patent [19]

Wärmling

[11] Patent Number: 4,760,813

[45] Date of Patent: Aug. 2, 1988

[54] DEVICE FOR ELIMINATING DISTURBING HEELING OF SHIPS AT LOADING AND UNLOADING

[75] Inventor: Bo Wärmling, Karlstad, Sweden

[73] Assignees: O. F. Ahlmark & Co. EFTR. AB, Karlstad; Nils Olsson Hydraulmontage AB, Sjalevad, both of Sweden

[21] Appl. No.: 32,970

[22] Filed: Apr. 1, 1987

Related U.S. Application Data

[63] Continuation of Ser. No. 822,300, filed as PCT SE85/00140 on Mar. 28, 1985, published as WO85/04378 on Oct. 10, 1985, abandoned.

[30] Foreign Application Priority Data

Apr. 3, 1984 [SE] Sweden ..... 8401837

[51] Int. Cl.[4] ..... B63B 21/16

[52] U.S. Cl. ..... 114/121; 114/230; 114/122

[58] Field of Search ..... 114/230, 179–181, 114/199–200, 293, 121, 122; 414/139, 140; 212/191

[56] References Cited

U.S. PATENT DOCUMENTS

| | | | |
|---|---|---|---|
| 704,155 | 7/1902 | Walters | 114/181 |
| 3,151,594 | 10/1964 | Collipp | 114/293 |
| 3,871,320 | 3/1975 | Berg et al. | 114/121 |
| 3,886,882 | 6/1975 | Thornburg et al. | 114/179 X |
| 4,200,052 | 4/1980 | Cunningham et al. | 114/230 |

FOREIGN PATENT DOCUMENTS

| | | | |
|---|---|---|---|
| 0006838 | 1/1980 | European Pat. Off. | 114/181 |

*Primary Examiner*—Sherman D. Basinger
*Attorney, Agent, or Firm*—Cushman, Darby & Cushman

[57] ABSTRACT

A device for eliminating the risk of disturbing heeling at loading and unloading of a ship (10) lying at a quay (12). The device includes a motor-operated winch (18) on the ship, the winch having a drawing member (20) in the form of one or more wires, belts or the like. This drawing member is arranged for attachment to the quay and runs out from the ship at a place (24) below the surface of water.

10 Claims, 1 Drawing Sheet

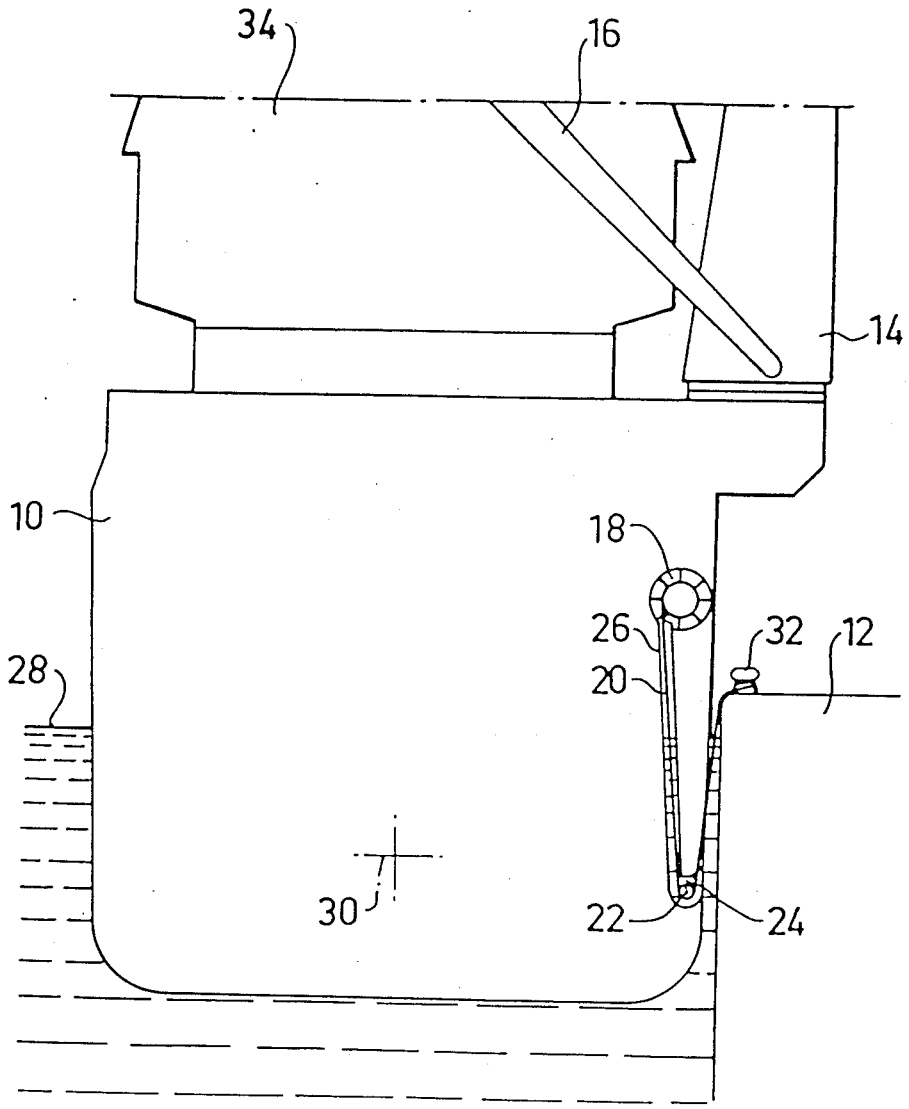
34
16
14
10
18
26
32
12
28
20
30
22
24

DEVICE FOR ELIMINATING DISTURBING HEELING OF SHIPS AT LOADING AND UNLOADING

This is a continuation of application Ser. No. 822,300, filed as PCT SE85/00140 on Mar. 28, 1985, published as W085/04378 on Oct. 10, 1985, which was abandoned upon the filing hereof.

This invention concerns a device for eliminating disturbing heeling at loading and unloading of a ship lying at a quay.

BACKGROUND OF THE INVENTION

In order to reduce costs in connection with ship transports it is of the greatest importance to reduce the periods of the boats lying still in port. Harbour dues and charges of utilized harbour equipment are very high. Thus, the cranes of the ships have tended to become ever bigger and more efficient. Nowadays they must be able to handle big standard cargoes intended to be loaded and transported on special ships with maximum stowing capacity. In this connection it may be worth mentioning that the ships are sometimes so dimensioned that they can pass the locks in certain canals only by a margin of a few centimeters along the sides and in stem and stern.

SUMMARY OF THE INVENTION

Now it has been found that the equipment of cargo handling has often got too high a lifting capacity, the result of which is that the ships sometimes may heel or tilt in a disturbing way at loading and unloading.

It is therefore the main object of the invention to provide a device which enables a safe stabilization of the ship at loading and unloading so that the risk of this heeling or tilting is quite eliminated. This stabilization is achieved according to the invention in that the device for eliminating heeling comprises a motor-operated winch placed on the ship and having a drawing member in the form of at least one wire, belt or the like, which is arranged to run out from the ship at a place below the surface of water for attachment to the quay.

Moreover, the device should be embodied so that it is capable of sensing the torsional force to which the ship is exposed at loading and unloading. This sensing capability is made possible in that the winch is provided with a motor brake with a braking capacity adjustable via a hydraulic system.

A pulley is preferably mounted on the inside of the ship, the drawing member running via the pulley through a tunnel between the winch and a hole in one side of the ship.

BRIEF DESCRIPTION OF THE DRAWING

The invention will now be described in greater detail in the form of a preferred illustrative example with reference to the enclosed drawing.

DETAILED DESCRIPTION OF THE PREFERRED EMBODIMENT

The drawing FIGURE shows a cross section of a part of a ship 10 provided with the new device for eliminating heeling and lying at a quay 12. Only the outer part of the hull is shown as well as part of the ship crane, the essential parts of which are the foundation 14 and the crane beam 16.

In the preferred illustrative example the device for eliminating heeling is placed substantially in the middle of the ship 10 as seen in its longitudinal direction and in close connection with the crane foundation 14. The motor-operated winch 18 associated with the device is placed easily accessible on the upper deck. It should be observed that the winch 16 is arranged on the same side as the crane foundation 14, i.e. on the side normally facing the quay 12.

The drawing member 20 is running from the winch 18 along the inside of the hull via a pulley 22 to a hole 24 in the side of the ship 10. The pulley 22 is running freely and arranged in a tunnel 26 extending between the winch 18 and the hole 24. The hole 24 is located below the surface of water 28 and preferably below the level of the rolling or torsional axis 30 of the ship 10. This arrangement means that there will always be water inside the tunnel 26 to substantially the same level as the surface of water 28 outside the ship 10. It is important that the pulley 22 and the hole 24 are as far down as possible along the side of the ship 10. In this way the ability of the drawing member 20 to eliminate heeling is increased as the member is attached to a bollard head 32 or the like on a quay 12.

The winch 18 shown on the drawing can e.g. be a mooring winch with automatic pulling at slackening in the drawing member 20. The braking capacity of the winch 18 is preferably adjusted by means of a hydraulic system not shown so that it corresponds to a value between e.g. 10 and 50 tons. The brake will then be released at the adjusted brake value which makes it possible to sense the maximum tensile force in the drawing member 20. When the crane is overloaded relative to adjusted braking capacity only a quite inconsiderable rocking movement will be observed in the ship 10 before the drawing member 20 is immediately stretched again after slackening. Accordingly as the ship 10 is loaded or unloaded its draught is altered but this shifting is automatically corrected with the winch 18 according to any known technique. The new device is preferably so embodied that the values of the load of the drawing member 20 are visually registrable continuously via a computer disposed on the captain's bridge 34.

Of course modifications of the device for eliminating heeling can be achieved within the scope of the invention. Thus the winch 18 can have various forms. Modification also applies to the extension of the drawing member 20. It should also be possible to have the drawing member 20 run along the outside of the ship 10 from the winch 18 to a breaking position below the water level 28. In connection with big ships it may possibly be necessary to arrange two or more devices for eliminating heeling interspaced along one ship side.

I claim:

1. A Device for eliminating distrubing heeling during loading and unloading of a ship lying at a quay with one side of the ship facing the quay, said device comprising a motor-operated winch arranged on the ship above the surface of water and having a drawing member in the form of at least one wire, belt or the like, characterized in that said drawing member is disposed to run out from the side of the ship facing the quay at a location below the surface of water for attachment to the quay above said surface of water.

2. The device of claim 1, characterized in that the drawing member runs from the winch to said location via a pulley.

3. The device of claim 2, characterized in that the drawing member runs through a tunnel between the winch and an opening in the side of the ship facing the quay.

4. The device of claim 1, characterized in that the winch is placed substantially in the middle of the ship as seen in its longitudinal direction and in close connection with a foundation for a ship crane.

5. Apparatus for stabilizing a ship against heeling during unloading or loading by a ship-mounted crane, while the ship lies with one side thereof facing a quay, said apparatus comprising: a motor-operated winch arranged on the ship above water level, said winch including a flexible drawing member which can be reeled in by and reeled out from the winch, said drawing member being attached to the quay close to said one side of the ship at a point above water level and extending downwardly from its attachment point along said one side of the ship to a location below water level and then to said winch above water level.

6. Apparatus as in claim 5 wherein said drawing member extends around a pulley at said below-water location and then upwardly to said winch above the water level.

7. Apparatus as in claim 6 wherein, between said pulley and said winch, there is a tunnel through said one side of the ship through which tunnel said drawing member passes, said tunnel having an end opening through said one side of the ship.

8. Apparatus as in claim 5 wherein said winch is located substantially in the middle of the ship as seen in its longitudinal direction and positioned substantially directly under the mounting for said crane.

9. The device of claim 1, characterized in that the location below the surface of water is also below the rolling axis of the ship.

10. Apparatus as in claim 5 wherein the location below water level is also below the rolling axis of the ship.

* * * * *